United States Patent [19]

Soderstrom et al.

[11] Patent Number: 4,470,164

[45] Date of Patent: Sep. 11, 1984

[54] CAP FOR THE FILL SPOUT OF A WATER BED

[76] Inventors: Keith A. Soderstrom, 11875 Miller Rd., Bainbridge Island, Wash. 98110; Michael Carpenter, 6925 San Tomas Rd., Baltimore, Md. 21227

[21] Appl. No.: 323,752

[22] Filed: Nov. 23, 1981

[51] Int. Cl.[3] ..... A47C 27/08; B65D 30/24; B65D 41/00; B65D 47/00

[52] U.S. Cl. ..... 5/451; 220/284; 222/563; 383/80

[58] Field of Search ..... 5/451, 450, 449, 452; 150/8; 220/284; 215/303; 222/563

[56] References Cited

U.S. PATENT DOCUMENTS

| | | | |
|---|---|---|---|
| 1,790,358 | 1/1931 | Tyrrell | 239/204 |
| 2,705,088 | 3/1955 | Van Blarcom | 222/563 |
| 3,600,727 | 8/1971 | Williams | 5/451 |
| 3,797,538 | 3/1974 | Mollura | 5/451 |
| 3,849,814 | 11/1974 | Ross | 5/451 |
| 3,925,835 | 12/1975 | Pennington et al. | 5/451 |

FOREIGN PATENT DOCUMENTS

| | | | |
|---|---|---|---|
| 237756 | 8/1925 | United Kingdom | 150/8 |

*Primary Examiner*—Alexander Grosz

*Attorney, Agent, or Firm*—Seed and Berry

[57] ABSTRACT

A preferred cap for the fill spout of a water bed comprises a screw cap having a top and a threaded flange which is capable of mating with the threaded portion of a fill spout, a turning knob, and a sliding shaft for connecting the screw cap to the turning knob. The shaft allows the knob to reciprocate between a first position substantially abutting the top of the cap and a second position raised above the top. In the raised position, turning of the knob turns the screw cap through the shaft, thereby unthreading or threading the screw cap onto the threaded portion of the fill spout. The knob may also be used as a handle to apply sufficient force to extract a retracted fill spout from its stored position in the envelope of the water bed.

To enhance sealing of a cap in a water bed, a sealing thimble may be used to fill the inner volume of the fill spout. An outwardly projecting flange of the thimble bears against the rim of the fill spout. When placed initially into the fill spout, the sealing thimble will reduce spillage while a screw cap is affixed to the fill spout. When firmly in place under the pressure of the screw cap, the sealing thimble will add greater insurance against seepage and leakage of the water bed through the spout.

12 Claims, 3 Drawing Figures

CAP FOR THE FILL SPOUT OF A WATER BED

DESCRIPTION

1. Technical Field

The present invention relates to an extensible and retractable cap for, for example, the fill spout of a water bed flotation mattress. More particularly, the invention relates to a cap including means for easing removal of the cap from the spout and extension and retraction of the spout into or out of the envelope of the water bed mattress. Enhanced sealing capability is provided with a sealing thimble inserted into the inner volume of the fill spout and held in position by a screw cap.

2. Background Art

Ordinarily, the fill spout of a water bed is retractable into the envelope of the water bed flotation mattress to be flush with the surface of the mattress. Threads on the outer portion of the fill spout mate with threads on the inner portion of a screw cap to close the opening. When attempting to empty the water bed, caps of this nature make extension of the fill spout difficult because very little surface is provided for grasping the cap. Because of the lack of space, it is also difficult to provide sufficient force to unscrew the cap. Unscrewing the cap would allow partial draining of the water bed before extending the spout. Even if possible, this type of draining could be messy.

DISCLOSURE OF THE INVENTION

To ease extension of the spout and removal of the screw cap of a fluid-containing envelope, such as a water bed flotation mattress, the cap of this invention includes means connecting the screw cap to an extensible knob so that the knob can be raised above the top planar surface of the screw cap. When the knob is raised, there is enough room to firmly grasp the knob to unwind the cap or to pull the pout from its retracted position.

When attempting to close a filled water bed flotation mattress, leaking may occur through the fill spout. To overcome this problem, a sealing thimble is inserted into the fill spout so that a flange on the upper surface of the thimble bears against the top rim of the fill spout. The thimble is a generally cylindrical cap with an outwardly projecting flange. Inserted after filling, the thimble checks flow of water while a screw cap (preferably of the novel design of this invention) is threaded onto the fill spout. Not only does the sealing thimble reduce leakage during sealing, but the thimble reduces seepage of water, and, therefore, reduces the possibility of leakage through the spout during use of the water bed.

BEST MODE FOR CARRYING OUT THE INVENTION

Figure 1:
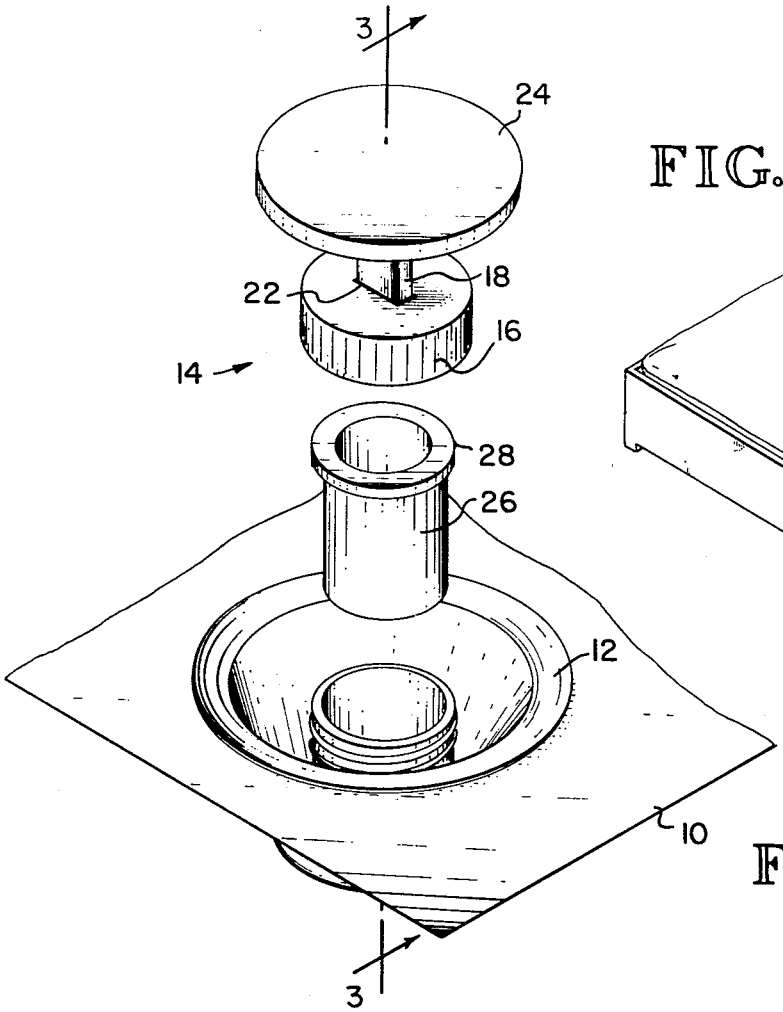
FIG. 1 is a schematic isometric of a water bed.
Figure 2:
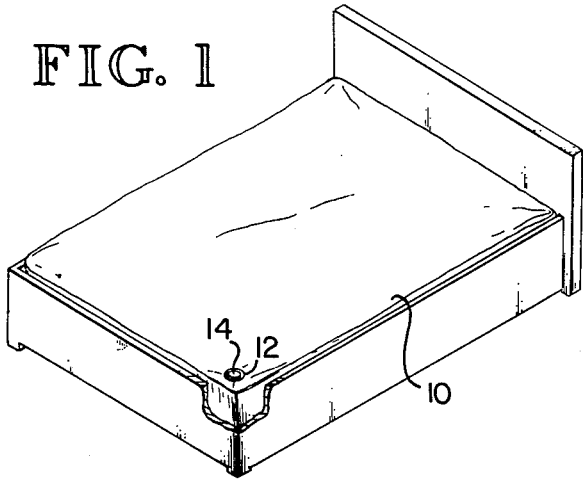
FIG. 2 is an isometric of a preferred cap of this invention.

As shown in FIG. 1, a water bed flotation mattress comprises an envelope 10 forming a generally closed geometric solid, such as a right rectangular parallelepiped, and a fill spout 12 sealed with a cap 14. A detail of the water bed envelope 10 near the fill spout 12 is best seen in FIG. 2.

Figure 3:
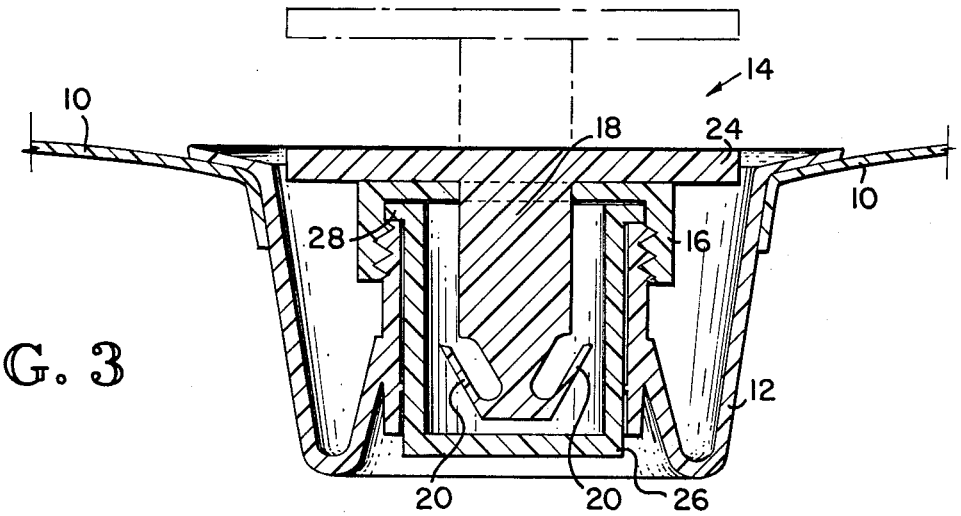
FIG. 3 is a cross-section of the cap of FIG. 2 taken along line 3—3 of FIG. 2.

The preferred cap 14 of this invention includes a screw cap 16 having a top surface and a flange including a threaded inner portion which is capable of mating with a threaded portion of the fill spout 12. As shown in FIG. 3, the fill spout 12 is usually retracted into its stored position in the water bed envelope 10. However, the fill spout 12 may be extended to form a nozzle which is more suitable for filling or draining the water bed mattress. Suitable means, such as a rectangular shaft 18, having at least one barb 20 to restrain the shaft 18 from removal from a slot 22 in the top of the screw top 16 is provided. As shown in FIG. 3, the barbs 20 are tapered to allow insertion of the shaft 18 through the slot 22 of the screw cap 16, but are then so shaped that extraction of the shaft 18 from the screw cap 16 is prevented.

The shaft 18 is connected to a turning knob 24. In operation, when the screw cap 16 is attached to the fill spout 12, extension of the fill spout 12 from its retracted position is facilitated by the design of the cap and related parts of this invention. By raising the turning knob 24 (as shown in phantom in FIG. 3), the turning knob 24 may be used as a gripping means to apply a force to extract the fill spout 12 from its retracted position. Alternatively, with the turning knob 24 elevated from its abutting position atop the top surface of the screw cap 16, the turning knob 24 may be turned to simultaneously unscrew the screw cap 16 from the fill spout 12. To accomplish the simultaneous turning, it is important that the shaft 18 include suitable means to couple the turning knob 24 to the screw cap 16. A rectangular shaft 18 has proven easy to construct and satisfactory in operation. Of course, other shapes, such as pentagons, octagons, triangles, or the like, may be used for the shaft cross-section.

To facilitate sealing of the water bed when it is filled, a sealing thimble 26 is inserted into the fill spout 12 so that a flange 28 on the thimble 26 bears against the top of the fill spout 12. The sealing thimble 26 acts as a temporary cap while the screw cap 16 is mated with the threaded portion of the fill spout 12. When the screw cap is mated, the sealing thimble 26 will aid against subsequent leakage because it occupies a substantially volume of the interior of the fill spout.

The low cost, injection-molded plastic caps of this invention make sealing of a water bed much easier. The cap of this invention is particularly desirable for draining an already filled water bed mattress. Then, the space between the nozzle portion of the fill spout and the envelope of the water bed is relatively small. Only the tips of one's fingers may be placed within this volume. Because of the small space, it is difficult either to extract the fill spout from its retracted position or to remove the screw cap. With the cap of this invention, these problems are overcome.

We claim:

1. A fluid-containing envelope having a fill spout adapted to be covered by a cap, the cap comprising:
   - a screw cap having a top and a threaded flange capable of threaded fitting with mating threads on the fill spout;
   - a turning knob axially movable above a slot on the cap; and
   - means for connecting the screw cap to the turning knob which allows the knob to reciprocate between a first position substantially abutting the top of the cap and a second position raised above the top so that the cap turns when the knob is turned.

2. The cap of claim 1, further comprising a sealing thimble held against a rim of the fill spout by the screw cap.

3. The cap of claim 1 wherein the screw cap has a slot in its top and the means for connecting the screw cap to the turning knob includes a shaft sliding in the slot and means for retaining the shaft within the slot in the top of the screw cap.

4. The cap of claim 3 wherein the means to retain the shaft includes at least one barb which allows passage of the shaft into the slot of the cap, but which prevents removal of the shaft back through the slot.

5. The cap of claim 3 or 4 wherein the shaft is rectangular.

6. The cap of claim 1 wherein the cap, knob, and means connecting the screw cap to the turning knob are all made from injection-molded plastic.

7. A cap for the fill spout of a water bed flotation mattress, comprising:

a screw cap having a slotted top and a threaded flange capable of threaded fitting with the fill spout;

a turing knob; and means for connecting the screw cap to the turning knob to allow the knob to reciprocate between a first position substantially abutting the top of the cap and a second position raised above the top of the cap, wherein the cap turns when the knob is turned, and including a shaft connected to the knob and having at least one barb for retaining the shaft in the slotted cap while allowing passage of the shaft into the slotted cap; and a sealing thimble held against a rim of the fill spout by the screw cap.

8. A water bed flotation mattress comprising:

an envelope forming a generally closed geometric solid;

a fill spout in the envelope;

a stopper to seal the fill spout, including a cap having a slotted top and being capable of sealing atop the fill spout;

a turing knob; and means for connecting the cap to the turning knob to allow the knob to reciprocate between a first position substantially abutting the top of the cap and a second position raised above the top to ease disconnecting of the stopper from the fill spout.

9. The water bed of claim 8 wherein the fill spout is foldably retractable into the envelope to form a substantially flush outer surface when sealed with the stopper, and wherein the stopper eases extension of the spout from its folded position by providing a gripping surface.

10. The water bed of claim 8 wherein the cap threads onto the fill spout.

11. A water bed flotation mattress comprising:

an envelope forming a generally closed geometric solid;

a fill spout in the envelope;

a sealing thimble to fit within the fill spout;

a stopper to hold the sealing thimble in the fill spout and to help to seal the fill spout from fluid leakage, said stopper including a cap having a slotted top and being capable of sealing atop the fill spout; a turning knob; and means for connecting the cap to the turning knob to allow the knob to reciprocate between a first position substantially abutting the top of the cap and a second position raised above the top to ease disconnecting of the stopper from the fill spout.

12. The water bed of claim 9 wherein the cap has a threaded flange capable of threaded fitting with the fill spout.

* * * * *